US007594345B2

(12) United States Patent
Fusco

(10) Patent No.: US 7,594,345 B2
(45) Date of Patent: Sep. 29, 2009

(54) ARTICLE OF FOOTWEAR HAVING SOLE WITH RIBBED STRUCTURE

(75) Inventor: Ciro Fusco, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 200 days.

(21) Appl. No.: 11/247,591

(22) Filed: Oct. 12, 2005

(65) Prior Publication Data

US 2007/0079530 A1 Apr. 12, 2007

(51) Int. Cl.
*A43C 15/02* (2006.01)
*A43B 13/14* (2006.01)

(52) U.S. Cl. ..... 36/59 R; 36/59 C; 36/103

(58) Field of Classification Search ..... 36/59 R, 36/59 C, 129, 25 R, 103; D2/953, 960
See application file for complete search history.

(56) References Cited

U.S. PATENT DOCUMENTS

D172,787 S 8/1954 Frary
4,546,559 A * 10/1985 Dassler ..... 36/129
4,578,883 A 4/1986 Dassler
4,615,126 A * 10/1986 Mathews ..... 36/102
D292,443 S 10/1987 Ihlenburg
D302,900 S 8/1989 Kolman et al.
4,972,613 A * 11/1990 Loveder ..... 36/105
D395,743 S * 7/1998 Ryan ..... D2/960
D399,342 S 10/1998 Carlson
5,829,172 A * 11/1998 Kaneko ..... 36/108
D405,597 S 2/1999 Carlson
D471,347 S * 3/2003 Haas et al. ..... D2/953
D487,331 S * 3/2004 Rogers et al. ..... D2/952
6,793,996 B1 9/2004 Umezawa
6,857,205 B1 * 2/2005 Fusco et al. ..... 36/114
D512,553 S * 12/2005 Robbins et al. ..... D2/954
2003/0131499 A1 * 7/2003 Silverman ..... 36/88
2004/0111922 A1 * 6/2004 Fusco ..... 36/59 R
2005/0155254 A1 * 7/2005 Smith et al. ..... 36/28

* cited by examiner

*Primary Examiner*—Ted Kavanaugh
(74) *Attorney, Agent, or Firm*—Banner & Witcoff, Ltd

(57) ABSTRACT

An article of athletic footwear comprising an upper for receiving the foot of a wearer and a sole structure attached to the upper, the sole structure having a heel portion including a rigid or semi-rigid ground contacting surface having a plurality of ribs located in the heel portion.

34 Claims, 3 Drawing Sheets

ARTICLE OF FOOTWEAR HAVING SOLE WITH RIBBED STRUCTURE

FIELD OF THE INVENTION

Aspects of the present invention relate to athletic footwear for running, and in particular hurdling. Aspects of the invention concern, more particularly, an article of footwear having a rigid or semi-rigid plate.

BACKGROUND OF THE INVENTION

Athletic footwear generally includes an upper and a sole structure. Usually formed of leather, synthetic materials, or a combination thereof, the primary purpose of the upper is to comfortably secure the wearer's foot to the sole structure while providing necessary ventilation and protection from the elements. The sole structure is attached to the upper and typically has a multi-layer construction which includes a sock liner (insole), midsole, and outsole. The sock liner is located within the upper and improves the comfort of the footwear. The midsole forms the cushioning layer of the sole and may be formed of a soft, yet resilient foam material that attenuates the impact forces of running, walking, or other movement. The outsole may be fashioned from a durable synthetic, such as rubber, to resist wear during use and includes spikes and ridges.

Although the upper and sole structure may be considered universal elements of athletic footwear, the specific sport for which footwear is intended to be used determines the individual, specialized characteristics of each element. Commonly, running shoes include lightweight elements that minimize the harmful effects of over-pronation; basketball shoes require components that stabilize the foot during quickly-executed direction changes, jumps, and stops; and football shoes incorporate cleats to ensure adequate traction on a natural turf surface. Accordingly, the primary differences between sport-specific styles of athletic footwear relate to the highly-refined features that make footwear appropriate for the demands of a particular sporting activity.

Shoes for track, in particular for passing over hurdles, also include a highly-refined set of elements that combine to form an article of footwear having characteristics specific to the track. The ideal track shoe includes a low profile design that provides little or no support for the shoe. In general, the thicker the sole of an article of footwear, the more unstable the footwear becomes. A low profile design thereby lends stability to an article of track footwear. A track shoe generally has spikes on the forward portion of the shoe to aid in traction, but is otherwise made of a smooth, slippery, material.

Often, when hurdling, the heel portion of the bottom of the shoe contacts the hurdle. Such contact can slow down the hurdler or make the hurdler trip and possibly fall.

BRIEF SUMMARY OF THE INVENTION

Aspects of the present invention relate to an article of athletic footwear having an upper and a sole structure attached to the upper. The sole structure includes an optional midsole and rigid or semi-rigid ground contacting surface (outsole or plate). The optional midsole may be attached to at least a portion of the upper and may be formed of a thin resilient, shock-absorbing material. The plate is attached to at least a lower portion of the upper or optional midsole and provides a wear-resistant outer surface.

The sole structure includes a rigid or semi-rigid ground contacting surface having a plurality of ribs located in the heel portion. The plurality of ribs is located longitudinally in the heel portion.

The various advantages and features of novelty that characterize aspects of the present invention are pointed out with particularity in the appended claims. To gain an improved understanding of the advantages and features of novelty that characterize aspects of the present invention, however, reference should be made to the descriptive matter and accompanying drawings which describe and illustrate preferred embodiments of the invention.

DETAILED DESCRIPTION OF THE INVENTION

Figure 1:
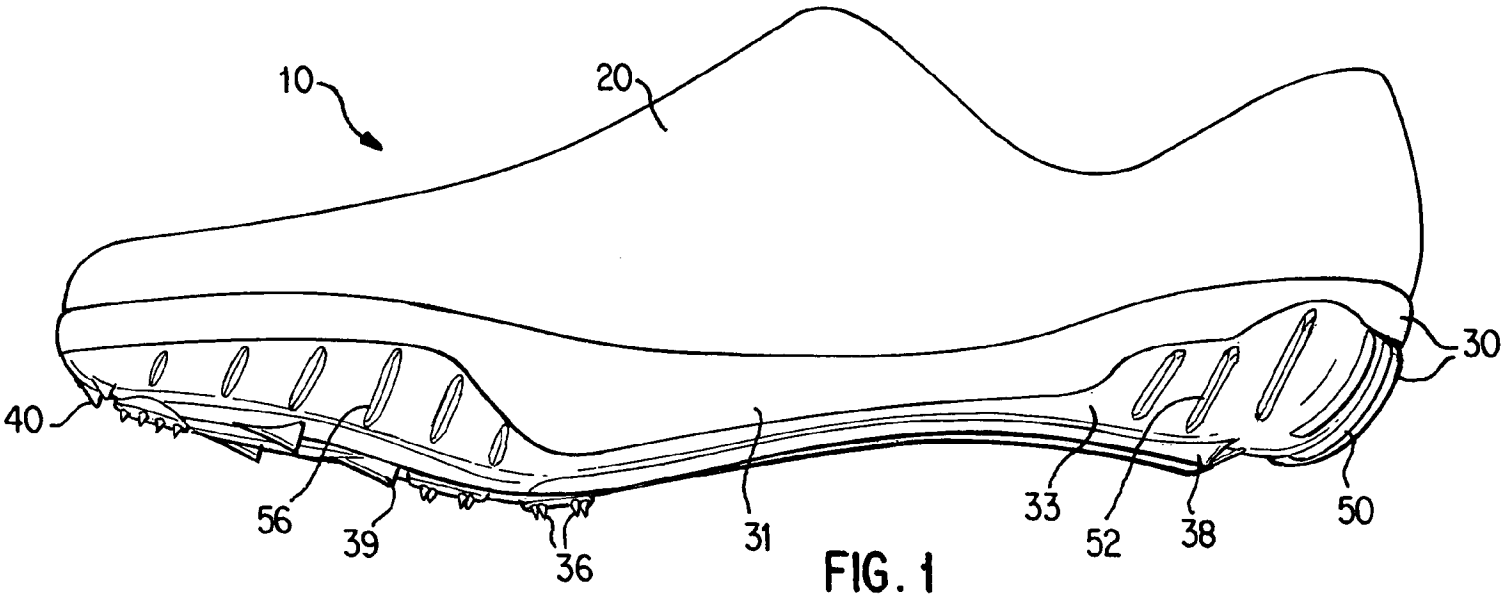
FIG. 1 is a medial side view of an article of footwear according to an aspect of the present invention.

Referring to the drawings, wherein like numerals indicate like elements, an article of footwear in accordance with aspects of the present invention is illustrated.

The footwear of is described in terms of hurdling footwear, but the concepts can be applied to other types of footwear as well including athletic and casual footwear.

With reference to FIG. 1, the primary elements of footwear 10 are an upper 20 and a sole structure 30. Sole structure 30 is attached to the lower portion of upper 20. As footwear 10 is track footwear, in particular for passing over hurdles, the footwear may be of minimal construction.

Upper 20 is configured to receive a wearer's foot and secure the foot to footwear 10. Typically, upper 20 includes a thin covering as is conventional in the art for track-style footwear. A sock liner may also be present and would be located within upper 20 and adjacent to the lower surface of the foot of the wearer and adjacent midsole 31. The sock liner may be removable.

Sole structure 30 has a multi-layered configuration which includes an optional midsole 31 and rigid or semi-rigid ground contacting surface ("plate") 33.

Midsole 31 forms a layer of sole structure 30 above plate 33 and typically provides cushioning and attenuation of impact forces upon contact with the ground. Midsole 31 may be formed of a variety of materials, including polyurethane and ethyl vinyl acetate (e.g. PHYLON) and may include one or more supplemental shock-absorbing components.

Plate 33 forms the lower layer of the footwear and provides a wear-resistant, ground-contacting surface. In comparison with a conventional rubber outsole, plate 33 is formed from a harder, more rigid member and a generally slippery surface or, in other words, a surface having a lower coefficient of friction. The advantage of the plate surface being slippery is that the plate surface does not slow or bog the runner down.

Figure 2:
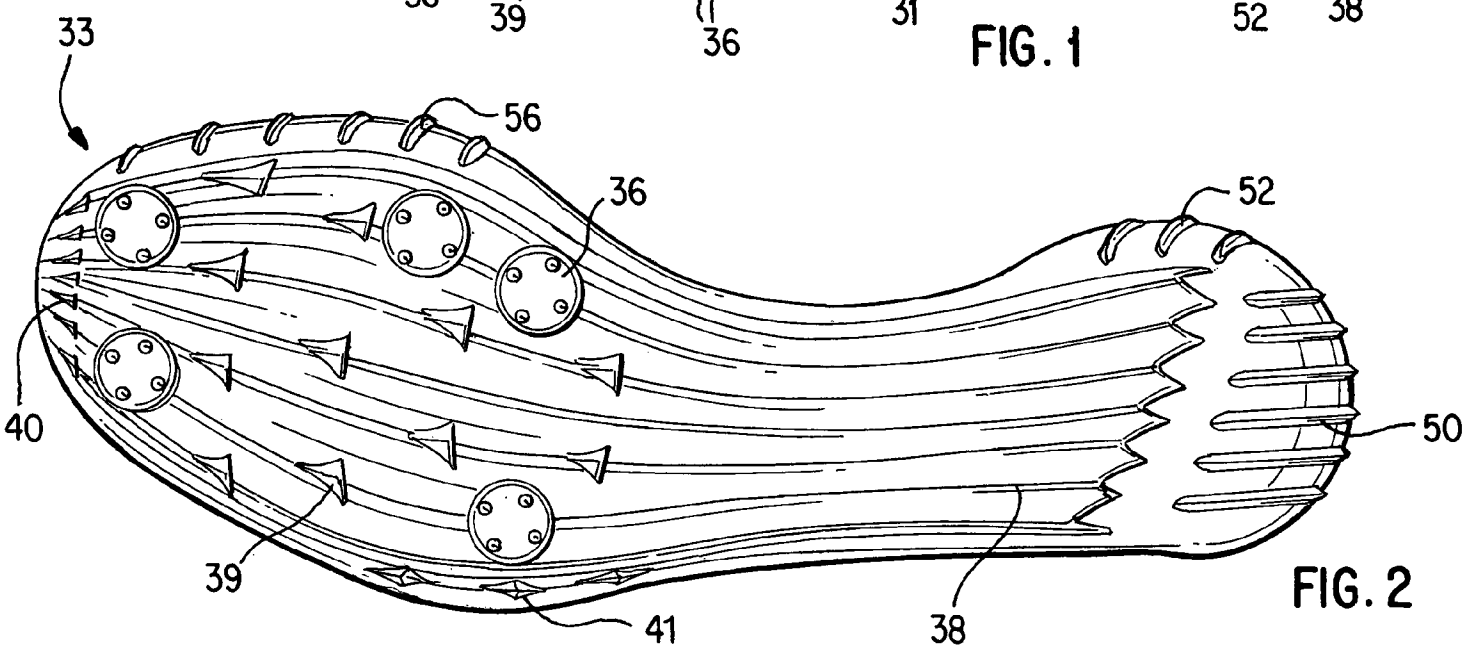
FIG. 2 is a bottom view of the plate for an article of footwear depicted according to an aspect of the present invention.
Figure 3:
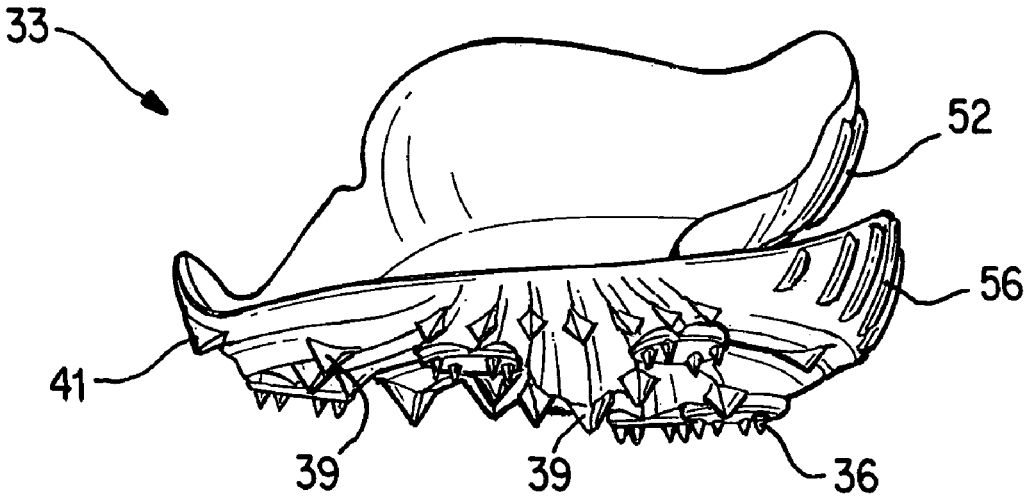
FIG. 3 is a front view of the plate for an article of footwear depicted according to an aspect of the present invention.

As shown in FIG. 2, typically, the plate contains spikes 36 for traction. The spikes are located on the bottom forward portion of the plate. The spikes may be any suitable spikes for track or hurdling footwear. The spikes 36 may contain a disk-like portion with short pins as shown. The spikes may be formed integrally with the plate, or may be attached. A center pin (not shown) may also be attached through a center hole of the spike to the plate by glue or screw. This pin may be of a conical design.

Figure 5:
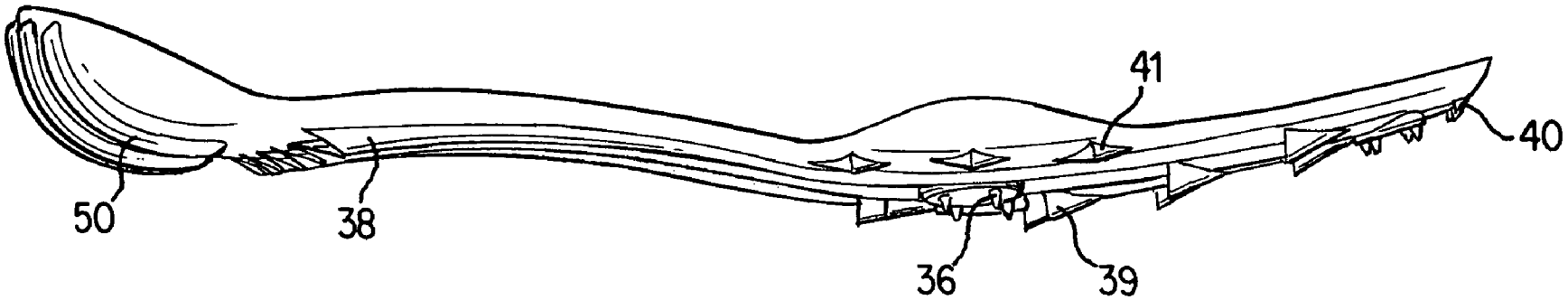
FIG. 5 is a lateral side view of the plate for an article of footwear depicted according to an aspect of the present invention.

In addition, as best shown in FIGS. 1, 2, and 5, the bottom forward portion of the footwear may contain longitudinal ridges 38. The ridges prevent the footwear from slipping sideways when running. Also present along the ridges may be several protrusions 39. These protrusions may have the configuration of triangular points, for example. The protrusions also provide traction.

Near the toe region of the plate, several (approximately 3-10) protrusions such as triangular points 40 may be present to aid the runner in, for example, starting the race. The triangular points press into the ground at the start to prevent slippage. Protrusions, such as triangular or diamond-shaped points 41, may also be present on the lateral side edge of the plate to prevent slippage. See FIGS. 1 and 5.

Figure 4:
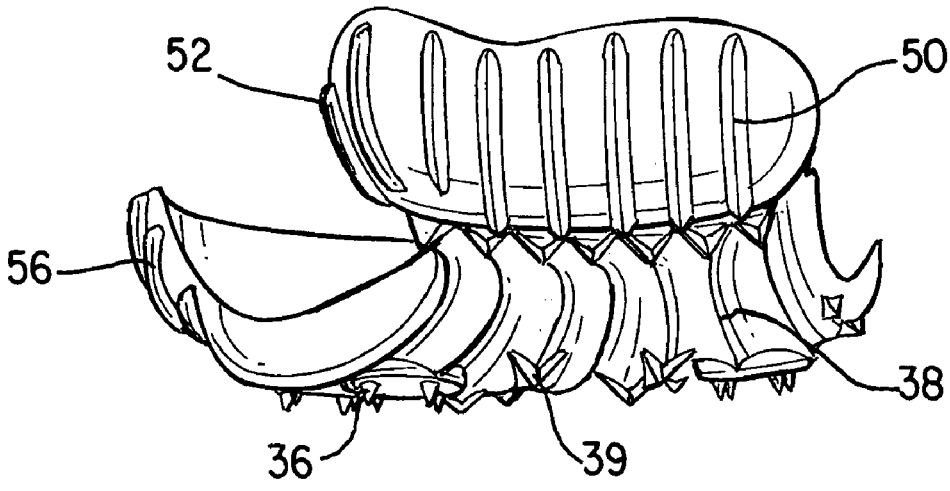
FIG. 4 is a back view of the plate for an article of footwear depicted according to an aspect of the present invention.

As shown in FIGS. 2, 4 and 5, in accordance with aspects of the invention, longitudinal ribs 50 are at least partially located in the heel region of the plate. The ribs are made of a slippery material and would typically be made of the same material as the plate. Generally, these ribs would contact the hurdle on the leading foot of the hurdler. That is, a leading foot generally goes over the hurdle in a straight forward motion since the leg is in a forward outstretched position. The likely point of contact of the leading foot is the heel region of the plate.

Ribs 50 allow only minimum contact of the footwear if contact is made to the hurdle. That is, instead of a flat heel surface which allows a large contact area, the ribs provide a significantly smaller contact area so that the footwear slides over the hurdle without slowing the hurdler or causing the hurdler to slip. In addition, since the ribs are longitudinal (correspond to the length of the footwear), the ribs do not get caught on the hurdle. The ribs typically wrap around the backside of the heel as shown in FIGS. 4 and 5.

Any suitable number of ribs 50 may be used, typically between three and ten. The ribs 50 may have any suitable cross-section, but generally are thicker next to the bottom of the plate and thinner at the portions of the ribs farthest from the plate. The portions of the ribs farthest from the plate are typically slightly rounded to avoid cutting into the hurdle.

At least one, generally 2-5 substantially vertically extending ribs, 52 may also be present along the medial side portion of the heel as shown in FIGS. 1 and 2. At least one, generally 2-10, substantially vertically extending ribs 56 may also be present along the medial side portion of the forefoot region of the plate as also shown in FIGS. 1 and 2. Generally, these medial ribs would contact the hurdle on the trailing foot. That is, the trailing foot tends to go over the hurdle at an angle such that the likely point of contact is the medial edge of the plate. The substantially vertically extending ribs may be slightly angled toward the rear as shown in FIGS. 1 and 2 to accommodate the angle of the trailing foot going over the hurdle.

The footwear may be customized to provide leading foot footwear and trailing foot footwear. Thus the leading foot footwear may contain the longitudinal ribs 50 but no ribs on the side of the footwear. The trailing foot may contain the ribs on the medial side of the footwear, but not on the heel.

The plate may be made by an injection molding process, for example. The plate is made of a slippery material having a low coefficient of friction. Typically, the plate is made from a polymeric material such polyamides (e.g. NYLON 6/6), acetal homopolymers (e.g. DELRIN) and polyurethane. Nylon is a crystalline thermoplastic polymer with properties that include outstanding wear and abrasion resistance, high in use service temperature, excellent impact resistance, excellent chemical resistance, low friction and self lubricating. Polyamides are generally easy to machine. Acetal homopolymers have high modules of elasticity, high strength and stiffness, low coefficient of friction, good abrasion, and impact resistance.

The desired flexible modulus of elasticity is about 250,000 to about 500,000 psi, or about 300,000 to about 400,000 psi, or about 320,000 to about 340,000 psi.

For additional slipperiness, the ribs in the heel and medial part of the plate may be coated with a hydrophilic material in order to reduce the coefficient of friction.

Preferably, the ribs are integrally made with the plate in the same injection molding process for example. However, ribs may also be attached to the plate utilizing adhesive or other suitable methods. If not integrally made with the plate, the ribs also should be made with a slippery material having a low coefficient of friction.

The present invention is disclosed above and in the accompanying drawings with reference to a variety of preferred embodiments. The purpose served by disclosure of the preferred embodiments, however, is to provide an example of the various aspects embodied in the invention, not to limit the scope of the invention. One skilled in the art will recognize that numerous variations and modifications may be made to the preferred embodiments without departing from the scope of the present invention, as defined by the appended claims.

I claim:

1. An article of athletic footwear comprising an upper for receiving the foot of a wearer and a sole structure attached to the upper, the sole structure having a heel portion, the sole structure including a rigid or semi-rigid ground contacting surface, wherein a plurality of distinct ribs is located longitudinally in the heel portion and each of the distinct ribs extends in a substantially parallel direction, wherein the heel portion is cup-shaped so that the back portion of the heel portion extends upwards from a bottom portion of the ground contacting surface and wraps around the backside of the heel, wherein at least a portion of the plurality of ribs curve around the back portion of the heel portion;

wherein the plurality of ribs comprises a slippery material.

2. The article of footwear of claim 1 wherein the plurality of ribs comprises 3 to 10 ribs.

3. The article of footwear of claim 1 wherein the ground contacting surface comprises a polyamide.

4. The article of footwear of claim 1 wherein the ground contacting surface has a flexural modulus of elasticity of about 250,000 to about 500,000 psi.

5. The article of footwear of claim 4 wherein the ground contacting surface has a flexural modulus of elasticity of about 300,000 to about 400,000 psi.

6. The article of footwear of claim 5 wherein the ground contacting surface has a flexural modulus of elasticity of about 320,000 to about 340,000 psi.

7. The article of footwear of claim 1 further comprising a plurality of ribs along the medial side heel portion of the rigid or semi-rigid ground contacting surface, wherein the plurality of ribs along the medial side heel portion comprises a slippery material.

8. The article of footwear of claim 7 wherein the plurality of ribs along the medial side heel portion are angled rearwardly so that an upper end of each of the ribs along the medial side heel portion is closer to the heel than a lower end of each of the ribs.

9. The article of footwear of claim 1 further comprising a plurality of substantially vertically extending ribs along the medial side forefoot portion of the rigid or semi-rigid ground contacting surface, wherein the plurality of ribs along the medial side forefoot portion comprises a slippery material.

10. The article of footwear of claim 9 wherein the plurality of ribs along the medial side forefoot portion are angled rearwardly so that an upper end of each of the ribs along the medial side forefoot portion is closer to the heel than a lower end of each of the ribs along the medial side forefoot portion.

11. The article of footwear of claim 1 further comprising a plurality of substantially vertically extending ribs along a majority of the bottom portion of the rigid or semi-rigid ground contacting surface, wherein the plurality of ribs along the bottom portion comprises a slippery material.

12. The article of footwear of claim 1 wherein at least the plurality of ribs is coated with a hydrophilic material.

13. The article of footwear of claim 1 wherein the rigid or semi-rigid ground contacting surface is coated with a hydrophilic material.

14. The article of footwear of claim 1 wherein the rigid or semi-rigid ground contacting surface further comprises cleats positioned in a bottom forefoot portion.

15. An article of athletic footwear comprising an upper for receiving the foot of a wearer and a sole structure attached to the upper, the sole structure having a heel portion, the sole structure including a rigid or semi-rigid ground contacting surface having a plurality of distinct ribs located longitudinally in the heel portion and each of the distinct ribs extends in a substantially parallel direction and wherein at least a portion of the plurality of ribs curve around the back portion of the heel portion, wherein the plurality of ribs comprises a slippery material, and further comprising a plurality of substantially vertically extending ribs along the medial side forefoot portion of the rigid or semi-rigid ground contacting surface, wherein the plurality of ribs along the medial side forefoot portion comprises a slippery material, wherein the ribs located longitudinally in the heel portion an the plurality of substantially vertically extending ribs along the medial side forefoot portion are protrusions that extend out of a face of the ground contacting surface to define a contact area which is substantially less than the face of the ground contacting surface.

16. The article of footwear of claim 15, wherein each of the ribs located in the heel portion, along the medial side forefoot portion and along the medial side heel portion are tapered so that they are thicker at the face of the ground contacting surface and become thinner as they extend away from the face of the ground contacting surface.

17. The article of footwear of claim 16, wherein each of the ribs located in the heel portion, along the medial side forefoot portion and along the medial side heel portion is rounded at an edge that is farthest from the face of the ground contacting surface.

18. The article of footwear of claim 15 wherein the plurality of ribs along the medial side forefoot portion are angled rearwardly so that an upper end of each of the ribs alone the medial side forefoot portion is closer to the heel than a lower end of each of the ribs along the medial side forefoot portion.

19. The article of footwear of claim 15 further comprising a plurality of substantially vertically extending ribs along the medial side heel portion of the rigid or semi-rigid ground contacting surface, wherein the plurality of ribs along the medial side heel portion comprises a slippery material, wherein the plurality of substantially vertically extending ribs along the medial side heel portion are protrusions that extend out of the face of the ground contacting surface to define a contact area which is substantially less than the face of the around contacting surface.

20. The article of footwear of claim 19 wherein the plurality of ribs along the medial side heel portion are angled rearwardly so that an upper end of each of the ribs along the medial side heel portion is closer to the heel than a lower end of each of the ribs along the medial side heel portion.

21. The article of footwear of claim 15 further comprising a plurality of ribs along the bottom portion of the rigid or semi-rigid ground contacting surface, wherein the plurality of ribs along the bottom portion comprises a slippery material.

22. The article of footwear of claim 15 wherein at least the plurality of ribs located longitudinally in the heel portion is coated with a hydrophilic material.

23. The article of footwear of claim 15 wherein the ground contacting surface has a flexural modulus of elasticity of about 250,000 to about 500,000 psi.

24. The article of footwear of claim 15 wherein the outsole further comprises a midsole attached to the upper surface of the outsole.

25. An article of athletic footwear comprising an upper for receiving the foot of a wearer and a sole structure attached to the upper, the sole structure having a heel portion, the sole structure including a rigid or semi-rigid ground contacting surface having 3 to 10 distinct ribs located longitudinally in the heel portion and each of the distinct ribs extends in a substantially parallel direction and wherein at least a portion of the ribs curve around the back portion of the heel portion, wherein the ribs comprises a slippery material, and further comprising a plurality of substantially vertically extending ribs along the medial side forefoot portion of the rigid or semi-rigid ground contacting surface, wherein the plurality of ribs along the medial side forefoot portion comprises a slippery material, and a plurality of substantially vertically extending ribs along the medial side heel portion of the rigid or semi-rigid ground contacting surface, wherein the plurality of ribs along the medial side heel portion comprises a slippery material, wherein each of the ribs in the heel portion, along the medial side forefoot portion and along the medial side heel portion are tapered so that they are thicker where they meet a face of the ground contacting surface and become thinner as they extend away from the face of the ground contacting surface.

26. The article of footwear of claim 25 wherein the substantially vertically extending plurality of ribs along the medial side forefoot portion and along the medial heel portion are angled rearwardly that an upper end of each of the ribs along the medial side forefoot portion is closer to the heel than a lower end of each of the ribs along the medial side forefoot portion and an upper end of each of the ribs along the medial side heel portion is closer to the heel than a lower end of each of the ribs alone the medial side heel portion.

27. The article of footwear of claim 25, wherein each of the ribs in the heel portion, along the medial side forefoot portion and along the medial side heel portion are protrusions that extend out of the face of the ground contacting surface to define a contact area which is substantially less than the face of the ground contacting surface.

28. The article of footwear of claim 27, wherein each of the ribs in the heel portion, along the medial side forefoot portion and along the medial side heel portion is rounded at an edge that is farthest from the face of the ground contacting surface.

29. The article of footwear of claim 28, wherein the ribs at the heel portion curve around the back portion of the heel portion and extend until they reach, or approximately reach, a top of the heel portion.

30. The article of footwear of claim 29, further comprising:

a plurality of longitudinal ridges along a majority of the bottom portion of the rigid or semi-rigid ground contacting surface.

31. The article of footwear of claim 30, further comprising:

a plurality of spikes positioned in a bottom forefoot portion of the ground contacting surface; and a plurality of protrusions with triangular points positioned in a bottom forefoot portion of the ground contacting surface.

32. The article of footwear of claim 31, further comprising:

a plurality of triangular or diamond-shaped points positioned in a toe region of the ground contacting surface; and one or more triangular or diamond-shaped points positioned on a lateral side of the ground contacting surface.

33. The article of footwear of claim 32, wherein a lateral side of the article of footwear does not have any ribs.

34. The article of footwear of claim 1, wherein the ribs curve around the back portion of the heel portion and extend until the ribs reach, or approximately reach, a top of the heel portion.

* * * * *

UNITED STATES PATENT AND TRADEMARK OFFICE

CERTIFICATE OF CORRECTION

PATENT NO. : 7,594,345 B2
APPLICATION NO. : 11/247591
DATED : September 29, 2009
INVENTOR(S) : Ciro Fusco It is certified that error appears in the above-identified patent and that said Letters Patent is hereby corrected as shown below:

In Column 5, Claim 15, Line 33:
Please delete the word "an" and insert --and--

In Column 5, Claim 18, Line 50:
Please delete "alone" and insert --along--

Signed and Sealed this

Twenty-fourth Day of November, 2009

David J. Kappos

David J. Kappos
*Director of the United States Patent and Trademark Office*